US011963603B2

(12) United States Patent
Bianco et al.

(10) Patent No.: US 11,963,603 B2
(45) Date of Patent: Apr. 23, 2024

(54) COSMETIC APPLICATOR WITH FLEXIBLE AND RIGID PORTIONS

(71) Applicant: Toly Management Ltd., Zejtun ZTN (MT)

(72) Inventors: Dorien Bianco, Zejtun (MT); Rahul Bose, New Delhi (IN)

(73) Assignee: Toly Management Ltd., Zejtun (MT)

( * ) Notice: Subject to any disclaimer, the term of this patent is extended or adjusted under 35 U.S.C. 154(b) by 53 days.

(21) Appl. No.: 17/475,958

(22) Filed: Sep. 15, 2021

(65) Prior Publication Data

US 2021/0401150 A1 Dec. 30, 2021

Related U.S. Application Data

(62) Division of application No. 16/851,526, filed on Apr. 17, 2020, now Pat. No. 11,425,984.

(30) Foreign Application Priority Data

Apr. 17, 2019 (IN) ..... 201911015486
Sep. 25, 2019 (IN) ..... 201911038894

(51) Int. Cl.
*A45D 34/04* (2006.01)

(52) U.S. Cl.
CPC ..... *A45D 34/046* (2013.01); *A45D 2200/10* (2013.01)

(58) Field of Classification Search
CPC ..... A45D 34/04; A45D 34/045; A45D 40/26; A45D 40/265; A45D 2034/007; A45D 2040/0012; A45D 2200/1018
(Continued)

(56) References Cited

U.S. PATENT DOCUMENTS 5,716,150 A * 2/1998 Gueret ..... A45D 40/267 401/128
6,227,737 B1 5/2001 Lightfoot
(Continued)

FOREIGN PATENT DOCUMENTS

CN 202714403 2/2013
DE 102011054507 4/2013
(Continued)

OTHER PUBLICATIONS

Beck, Tina; Machine Translation of DE102011045507 (Year: 2013).*

*Primary Examiner* — David P Angwin
*Assistant Examiner* — Bradley S Oliver
(74) *Attorney, Agent, or Firm* — Wissing Miller LLP

(57) ABSTRACT

A cosmetic applicator for applying a product including a cosmetic, care or pharmaceutical composition onto the keratinous substrate such as skin, lips, under eyes, eyelids, cheeks, or any other part of the body. The cosmetic applicator includes an applicator head having an applying member and a shank portion. The applying member includes a stiffness modifying portion to modify the resistance of the applying member to deflection in a transverse direction. In one embodiment the applying member comprises a first application face and a second application face. The stiffness modifying portion comprises a hinge formed between the shank portion and the applying member. The hinge is limited to a single zone in a circumference of the applicator head to provide flexibility to the applying member giving user the feeling that the applying member is very soft and resilient. According to another embodiment the applying member comprises a planar spatula member with a first face and an opposite second face. The applying member further includes two convex bulges, namely a first convex bulge and a second convex bulge extending in opposite directions from respec-
(Continued)

tive of the first face and the second face of the spatula member. The bulges increase the stiffness of a portion of the applying member.

9 Claims, 10 Drawing Sheets

(58) Field of Classification Search
USPC ..... D28/7
See application file for complete search history.

(56) References Cited

U.S. PATENT DOCUMENTS

| | | | | |
|---|---|---|---|---|
| 7,134,799 | B2 | 11/2006 | Gueret | |
| D541,979 | S * | 5/2007 | Montoli | D28/7 |
| 7,677,826 | B2 | 3/2010 | Gueret | |
| D638,988 | S * | 5/2011 | Limongi | D28/7 |
| 8,286,649 | B2 | 10/2012 | Gueret | |
| 9,468,280 | B2 | 10/2016 | Uehara et al. | |
| 10,010,151 | B2 | 7/2018 | Gueret | |
| 2007/0020027 | A1* | 1/2007 | Gueret | A45D 40/262 401/126 |
| 2007/0181143 | A1 | 8/2007 | Montoli | |
| 2008/0317542 | A1 | 12/2008 | Gueret | |
| 2012/0192893 | A1* | 8/2012 | Anderson | A45D 24/12 132/271 |

FOREIGN PATENT DOCUMENTS

| | | | |
|---|---|---|---|
| GB | 2094235 | * | 9/1982 |
| JP | 2015047360 | | 3/2015 |

* cited by examiner

COSMETIC APPLICATOR WITH FLEXIBLE AND RIGID PORTIONS

This application claims priority under 35 U.S.C. § 119 to Indian Provisional Patent Application No. 201911015486, filed on Apr. 17, 2019 and Indian Provisional Patent Application No. 201911038894, filed on Sep. 25, 2019. The disclosure of each of these applications is incorporated herein by reference. This application is a divisional of U.S. patent application Ser. No. 16/851,526, filed on Apr. 17, 2020, the disclosure of which is incorporated herein by reference.

BACKGROUND

Field

The present disclosure relates generally relates to a cosmetic applicator for applying a product including a cosmetic, care or pharmaceutical product, onto keratinous substrate such as skin, lips, under eyes, eyebrows, eyelids, cheeks, nails or any other part of the body. In particular, the disclosure relates to an applicator for cosmetic products that provides ridged and flexible applicator surfaces to applying the product onto the keratinous surface.

Description of the Related Art

Devices exist for dispensing cosmetic or medicinal products. Such devices usually consist of a container carrying cosmetic or medicinal products, a delivery mechanism for displacement of the cosmetic or medicinal products, and an applicator. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

Many cosmetic materials that, unlike lipstick bullets or eyebrow pencils, are flowable or otherwise non-self-sustaining in shape, are packaged and sold in a container which holds a body of the material and from which the material is transported and applied to a user's skin by an applicator device. Cosmetic applicators such as dip or wand applicators are known in the cosmetic industry. Cosmetic packages often include such applicators for dispensing a particular cosmetic contained in the package reservoir.

The cosmetic applicator generally includes a stem with a cap at one end and an applicator head in the form of a brush, spatula or other applicator structure suitable for applying a cosmetic or a care product including viscous cosmetics, mascara, eye liner, lip gloss, hair color, wound care, skin care, under eye cosmetics, pharmaceutical and like products. Commonly, the cap seats on and closes the mouth or opening of the container, the cosmetic applicator being immersed in the container body of cosmetic material when the cap is in the container-closing position. The cap serves as a handle for the user when the applicator, bearing a quantity of the cosmetic material, is withdrawn from the container and applied to the skin.

Cosmetic applicators are designed to provide user with the perception that the applicator is soft in its feel on the skin. Various flexible materials are used to provide flexibility to the applicator head in order to achieve sensation of softness to the skin of the user. For example, latex foam or other foam is used as flexible material, the sensation of softness is provided by the resilience of the foam.

In order to avoid high cost materials, flexible zones or regions are created in structure of cosmetic applicator to achieve desired flexibility of the cosmetic applicator. One such cosmetic unit is disclosed in U.S. Pat. No. 5,716,150 A for application of a product of a pasty or powdery consistency. The cosmetic applicator includes a stem having a first free end joined to an applicator end fitting in contact with the product and being intended for the application of this product to a surface to be treated, a second end of the stem being joined to a gripping element, wherein the applicator end fitting has a flexible central core having in at least one portion close to its end part.

Another applicator is disclosed in U.S. Pat. No. 6,227,737 B1 for applying a correction fluid to a surface. The fluid applicator comprises a cap, a substantially rigid stem extending from the cap, a connecting part, at a terminal end of the elongated stem, and a porous absorbent applicator tip is connected to an end of the stem by the connecting part. The connecting part defining a flexible region between said stem and an end of said applicator tip, whereby said connecting part is capable of flexing resiliently as the applicator tip is stroked across a paper surface, which allows the applicator tip to be deflected from a normal position in which the applicator tip is substantially aligned with the stem to a position substantially perpendicular to the normal position.

Another drawback of conventional cosmetic applicators is that they may be configured to apply a single type of composition, for example by applying only make-up product or a skin care product. An applicator configured to only implement a single task may be inconvenient to use.

The applicator surface of a conventional applicator to apply such products is typically fixed. That is, the applicator surface is generally either flexible or rigid. When the applicator surface is rigid, it may not conform to surfaces when it is used. For example, when the applicator is moved over the skin the difference of the shape of the face of the user and changes the pressure applied to a portion of the applicator surface may not deform the applicator. This may result in a non-uniform distribution of the product to the target surface. On the other hand, a flexible applicator may deposit a uniform coat of product on skin of a user, but if a user also needs to rub the product into the skin, such a flexible cosmetic applicator may fail to fulfill this requirement.

When the user needs to implement to multiple tasks such as rubbing of a product into the skin and uniform spreading of the product, a single conventional applicator may not be suitable. For example, cosmetic or pharmaceutical formulas that contain additive beads may require a cosmetic applicator having both a hard region to break the beads to release the additive into the main formula, as well as a soft/flexible region on the cosmetic applicator that permits even coating of the product on skin of the user.

Thus, there still exists a need for an applicator for applying a cosmetic product to human skin or keratinous substrate which allows flexing of the applicator when the product is applied on the application surface and that allows a single applicator to have both flexible and relatively rigid zones.

SUMMARY

The present disclosure provides embodiments of a cosmetic package that can be easily configured to contain a product and a cosmetic applicator.

The present disclosure provides embodiments of a cosmetic package having a cosmetic applicator with which a larger amount of a cosmetic product can be applied without having to dip the cosmetic applicator into the cosmetic container occasionally.

The present disclosure provides embodiments of an applicator which offers a comparatively large surface area, very simple to use, economic to manufacture and aesthetically pleasing.

The present disclosure provides embodiments of a combined cosmetics package that comprises separable components that fit securely together so as to make a unitary package.

The present disclosure provides embodiments of a cosmetic applicator that is comfortable and easy to use.

Accordingly, there is provided a cosmetic package comprising a receptacle and a cosmetic applicator. The receptacle is configured to contain a product including a cosmetic, care or a pharmaceutical product. The cosmetic, care or pharmaceutical product includes viscous cosmetics, mascara, eyebrow powder, lip gloss, hair color, cheek blush, skin care, under eye cosmetics, pharmaceutical and like products. In alternate embodiments, the receptacle may include a separate inner reservoir to hold a volume of the product to be dispensed.

According to an embodiment, the cosmetic package is of an elongated cylindrical configuration. In alternate embodiments, the cosmetic package may be of an elongated square, polygonal configuration, oval, triangular, heart, or any other configuration known in the art.

A wiper is provided inside the neck of the container for wiping off excess cosmetic product from the cosmetic applicator. According to one embodiment, the wiper comprises an annular bead on its outer surface for engaging into a corresponding annular groove formed on an inside surface of the neck of the receptacle. The wiper comprises a wiping orifice sized to engage with the applicator.

According to an embodiment, the receptacle and the closure may be made of a rigid material like glass, metal, hard plastic or any other material known in the art. In alternate embodiments, the receptacle and the closure are made of a flexible material, for example, a flexible polymeric material or any other material known in the art.

According to some embodiments, the cosmetic applicator comprises an applicator head, a stem and a cap. The applicator head is retained at a distal end of the stem for applying the cosmetic product; and the cap at a proximal end of the stem. According to an embodiment, the cap of the cosmetic applicator has threads on its inner surface which can be screwed onto threads, formed on an outer surface of a neck of the receptacle. In alternate embodiments, the cap snaps into place on the neck of the receptacle or any other type of mechanisms may be used to mate the cap to the receptacle.

The applicator head comprises an applying member and a shank portion. The shank portion is configured to be received within the cavity of the stem. The applying member has an elongated support body extending along a longitudinal axis of the cosmetic applicator.

According to an embodiment of the present disclosure, the stem can have a longitudinal axis that is rectilinear. In alternate embodiments, the stem is curved.

According to an embodiment of the present disclosure, the stem presents a cross-section that is circular. According to other embodiments the cross-section of the stem is another shape including oval, elliptical or polygonal, e.g. square, triangular or rectangular. The stem can be solid as shown, or, in a variant, it could be hollow.

When the stem is not of circular cross-section, the closure may be fastened on the receptacle by snap-fastening or by some other means, without turning relative to said receptacle. According to these embodiments, the wiper may have a non-circular wiper orifice that is complementary to the cross-section of the stem.

According to an embodiment of the present disclosure, the applicator head is made, at least in part, from a material that is more flexible than a material from which the stem is made.

According to an embodiment of the present disclosure, the applicator head and the stem are fitted together by a snap fitment. In alternate embodiments, the applicator head and the stem are fit together by friction fit, by gluing, crimping, magnetic engagement and the like.

According to some embodiments, the distal end of the stem includes an interior longitudinal cavity for receiving and retaining the applicator head. The applicator head comprises said applying member at its distal portion and a shank member at its proximal portion. The shank member is configured to be received and retained within the interior longitudinal cavity of the stem.

In general, the use of the terms "distal" and "proximal" herein is supposed to mean that the distal side/end is the side/end facing towards the inside of the storage receptacle, whereas the proximal side or proximal end is the side or end facing towards the removal opening of the receptacle.

According to a first embodiment of the disclosure, the applying member comprises at least two application faces namely a first application face and a second application face. The first application face has a concave surface, and wherein the concave surface extends from a proximal end of the applying member to a distal end of applying member. The concave surface creates a volume reservoir. This volume reservoir serves as a reservoir for the cosmetic product. A significant quantity of the cosmetic product may be accommodated in said volume reservoir which is available to be applied to a user's skin or keratinous substrate.

The second application face has a convex surface which is followed by an inclined flat surface. The convex surface is located at a proximal portion of the applying member and the inclined flat surface is located at a distal portion of the applying member. More particularly, the convex surface extends from the proximal end up to a mid-length of the applying member. The inclined flat surface extends from the mid-length of the applying member to a distal end of the applying member. A pointed tip is formed at the distal end of the applying member. The inclined flat surface helps in precise deposition of the cosmetic product on applying the cosmetic product on the user's skin or keratinous substrate. For example, when the cosmetic product is applied on the user's lip edge, the tip may be used to form a perfect cupid's bow, that is, a facial feature where the double curve of a human upper lip is said to resemble the bow of Cupid, the roman god of erotic love.

According to a further aspect of the present embodiment, a hinge is formed between the proximal end of the applying member and a distal end of the shank portion. The hinge reduces the cross section of the applying member and modifies the stiffness of the applicator head with respect to the shank, which is fixed to the stem. The hinge is formed by intersection of two cutting planes wherein one of the two planes is orthogonal to the longitudinal axis of the cosmetic applicator or in other words one of the planes is parallel to a transverse axis of the cosmetic applicator. Further, the hinge is present at one side of the applicator head only. Particularly, there is a single hinge in the applicator head limited to a single zone in a circumference of the applicator head between the shank portion and the applying member.

More particularly, the hinge is on a side of the applicator head, where the first application face of the applying member is located. In alternate embodiments, the hinge is on a side of the applicator head where the second application face of the applying member is located. The location and dimensions of the hinge determine a stiffness of the applicator head to forces applied to the first and/or second application face. For example, where the hinge is located on the side where the first application face is located, stiffness will be reduced for forces applied on the opposite, second application face toward the longitudinal axis.

According to an embodiment of the present disclosure, the hinge is to provide flexibility to the applying member which abuts against the shank portion of the applicator head when flexed. The flexibility provided by the hinge is to give user the feeling that the cosmetic applicator is very soft and resilient.

According to an embodiment of the present disclosure, the applying member flexes from a non-flexed state into a completely flexed state. In the completely flexed state, the applying member completely flexes in a single axis, the single axis being a pivot axis of the hinge, while resisting deflection in any other axes. This orientation provides the user with maximum feeling of softness and control of the cosmetic applicator.

According to a second embodiment of the present disclosure, the applicator head comprises an applying member and a shank portion. The applying member comprises at least two application faces namely a first application face and a second application face. The first application face is opposite to the second application face. The first application face has a substantially flat surface which extends from a proximal end to a distal end of the applying member. The second application face has a first convex surface near a proximal portion, a concave surface at a middle portion and a second convex surface near a distal end portion of the applying member. The second application surface when seen from the proximal end to the distal end of the applying member, comprises the first convex surface which is followed by the concave surface which in turn is followed by the second convex surface.

According to an aspect of the second embodiment, the first convex surface of the second application face forms of a bulbous portion on the second application face. According to a further aspect of the present disclosure, there is drastic decrease in thickness of applying member afterwards the bulbous portion of the applying member. In other words, the thickness of applying member decreases from the proximal portion to the middle portion of the applying member.

According to an aspect of the present embodiment, a thickness of the proximal portion is at least twice a thickness of the middle portion or the distal portion of the applying member. According to an embodiment of the present disclosure, a concave region is created due to reduced thickness between the proximal end and the distal end of the applying member. More particularly, the concave region is formed between the proximal end and the middle portion of the applying member on the second application face. The concave region creates a volume reservoir. This volume reservoir serves as a reservoir for the cosmetic product. A significant quantity of the cosmetic product may be accommodated on said volume reservoir which is then ready to be applied to the user's skin or keratinous substrate.

According to an embodiment of the present disclosure, a hinge is formed similarly as explained for the first embodiment.

According to an embodiment of the present disclosure, the applicator head can be made, at least in part, from a material that is more flexible than a material from which the stem is made. According to an embodiment of the present disclosure, at least a part and preferably all of the applicator head can be made by molding, e.g. by injection-molding, using a material selected from thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP, and the like.

According to an embodiment of the present disclosure, the applying member is covered with application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the surface of the applying member may be achieved by an appropriately chosen known technique, such as electrostatic flocking. The applying member before being flocked is smooth on its entire surface. That is, the applying member before being flocked has no surface textures, such as a wrinkle finish or a matte finish, over the entire surface thereof. To put it another way, the applying member before being flocked is smooth and slippery.

Preferably, the flocking process takes place in an electrostatic field, which results in the proper orientation of the fibers. The flock on the applying member provides a layer which can hold a small amount of the cosmetic product adequate for one or two applications. In alternate embodiments, the applying member may include injection molded fibers, projections or grooves which are capable of holding the cosmetic product.

According to a third embodiment, there is provided a cosmetic applicator comprising an applying member having at least one rigid region and at least one flexible region on the applying member. The at least one rigid region provides bending resistance during application and forms a suitable surface that allows to rub a product into the skin of a user. The at least one flexible region of the applying member flexes to adjust according to contour of the application surface during application allowing even and smooth application of the product. The rigid region is connected with the flexible region and with a shank of the applying member that connects the applying member to the stem. The rigid region increases the cross section of the applying member near the shank and modifies the stiffness of the applying member, making the applying member more stiff and allowing a user to apply greater force when applying substances, for example, cosmetics including crushable beads.

According to an aspect of the present disclosure, there is provided a cosmetic package for storing a product of a liquid or viscous nature, with or without additive beads. The cosmetic package comprises a receptacle for holding the product and the cosmetic applicator.

According to an aspect of the present disclosure, the applying member is elongated along a central longitudinal axis of the applicator head. Further, the applying member comprises a spatula member which is substantially a planar thin plate like structure. The spatula member has two opposite main application faces opposite to each other, namely a first face and a second face.

The applying member further includes two convex bulges, namely a first convex bulge and a second convex bulge extending in opposite directions from respective of the first face and the second face of the spatula member. Each of the first and second convex bulges extends along a longitudinal direction from a root portion of the applying member to up to at least a half a length of the respective first and second faces. The bulges modify the stiffness of the applying member.

According to an embodiment of the present disclosure, an outer surface of the applying member is covered with application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the outer surface of the applying member may be achieved by an appropriately chosen known technique, such as electrostatic flocking. The applying member may be flocked over substantially its entire visible surface. In a variant, at least one of the first and second convex bulges of the applying member may be flocked. In yet another variant, a portion of the spatula member free from the first and second convex bulges that is used for applying the composition may be flocked.

According to an aspect of the present disclosure, the first and second convex bulges define the rigid region on the applying member that provides bending resistance during application and forms a suitable surface that allows to rub the product into the skin of a user. The portion of the spatula member which is free from the first and second convex bulges defines a flexible region which is flexible enough to flex and adjust according to contour of the application surface, thus allowing even and smooth application of the product during application.

According to yet another aspect of the present disclosure, the spatula member comprises two lateral edges, namely a first lateral edge, and a second lateral edge which converge towards each other to form an off-centered pointed tip at a distal end of applying member with respect to the central longitudinal axis of the applicator head. The first and second lateral edges are outwardly convexly curved, wherein the curvature of the convex curve of lateral edge is different from the curvature of the convex curve of the lateral edge.

According to yet another aspect of the present disclosure, each of the first and second convex bulges has an off-centered distal end with respect to the central longitudinal axis of the applicator head.

According to yet another aspect of the present disclosure, each of the first convex bulge and the second convex bulge are spaced away from the first lateral edge and the second lateral edge of the spatula member.

According to a further aspect of the present disclosure, the off-centered pointed tip of the spatula member and the off-centered distal ends of the convex bulges lie on opposite sides/directions of the central longitudinal axis, when viewed from front or back of the applying member.

According to an aspect of the present disclosure, the each of first and second convex bulges are asymmetric with respect to the longitudinal axis of the applying member. The first and second convex bulges may be identical in shape and dimensions and extend parallel to each other over their entire length. In alternate embodiments, the first and second convex bulges may not be identical in shape and dimensions and may or may not extend in parallel directions.

According to an embodiment of the present disclosure, a maximum thickness of the each of the first and the second convex bulges is about 100 to 200% greater than a thickness in the spatula member. Preferably, each of the first and second convex bulges has a thickness which varies along the longitudinal axis of the applying member. Preferably the thickness of the first and second convex bulges increases from its proximal end to reach a maximum at around a mid-length and then decreases towards its distal end.

In accordance with the present disclosure, the first and second convex bulges extend perpendicular from the first face and the second face of the spatula member respectively, and each having a maximum thickness on the average from about 1 mm to about 3 mm, in particular from about 1 mm to about 2 mm. Preferably, the spatula member has an average thickness of at least about 0.5 mm, and particularly no more than about 2 mm, more in particular in the range from about 0.5 mm to about 1 mm.

Preferably, the length of each of the first and second convex bulges is about at least 60% of a total length of the spatula member but less than 90% of the length of the spatula member.

Preferably, the total length each of the first and second convex bulges is longer than its width, for example several times larger than the width of the convexity, i.e. more than 2, 3, 4, 5 or 6 times its width.

When seen from a proximal end towards the distal end of the applying member, the width of the convex bulges first increases, reaches a maximum and then decreases. When seen from a proximal end towards the distal end of the applying member, the width of the spatula member first increases, reaches a maximum and then decreases.

The first and second convex bulges may have any geometric cross-section, and may be, e.g., a rounded or have a rectangular, triangular, square, or an irregular cross-section.

According to a further aspect of the present disclosure, the spatula member is flexible enough to flex during application along contours of the human facial skin or lips so as to provide an even coating of the cosmetic product. Further, the pointed tip at the distal end allows the user to draw precision lines during application. According to a further aspect of the present disclosure, the applying member picks up generous amount of product near a base of the first and second convex bulges, reducing the need to re-dip the applicator during application of a cosmetic product.

According to an embodiment of the present disclosure, at least a part and preferably all of the applicator head can be made by molding, e.g. by injection-molding using a suitable material. Such a material may be selected from thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); and the like.

The present disclosure is not limited to the embodiments disclosed herein. It should be interpreted as having a range. Skilled artisans may modify, combine, or replace elements of disclosed embodiments and not depart from the scope of the invention. In addition, those skilled in the art may change or modify the disclosed embodiments, based on the present specification. Such changes or modifications also belong to the scope of the present invention as will be apparent from the flowing description.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes described herein. As another example, the materials used for various components can be different from those mentioned specifically herein.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
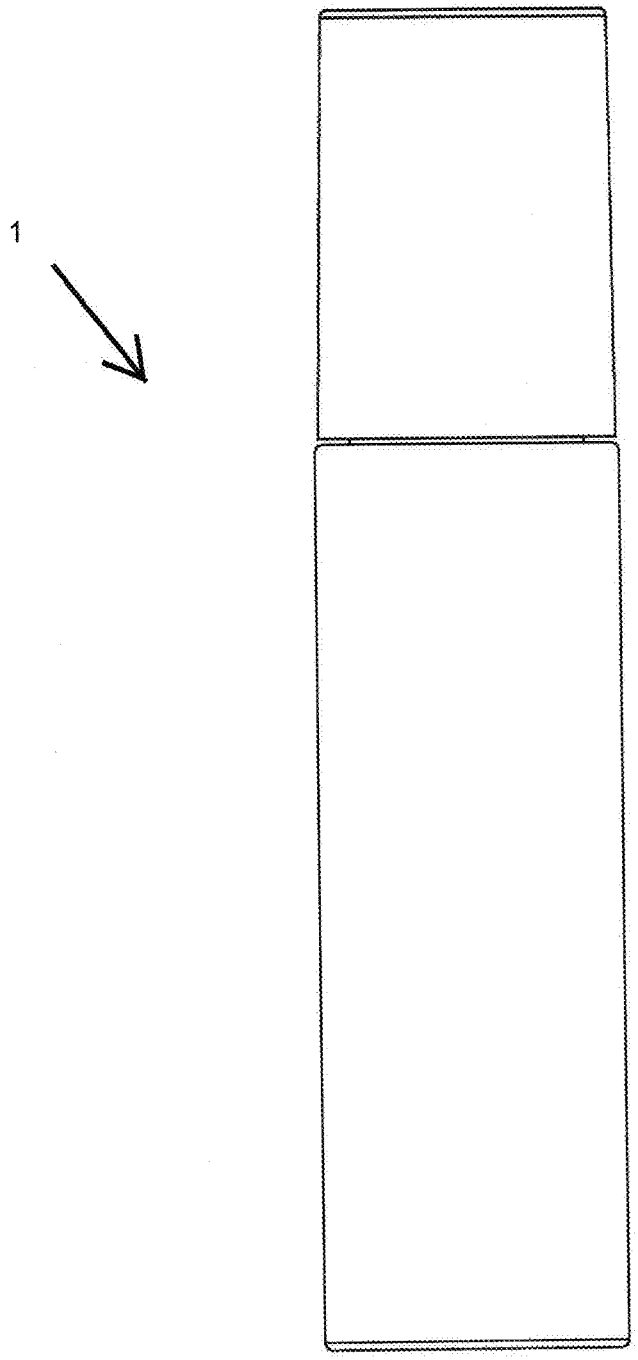
FIG. 1 illustrates a front view of a cosmetic package in closed position according to an embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Figure 2:
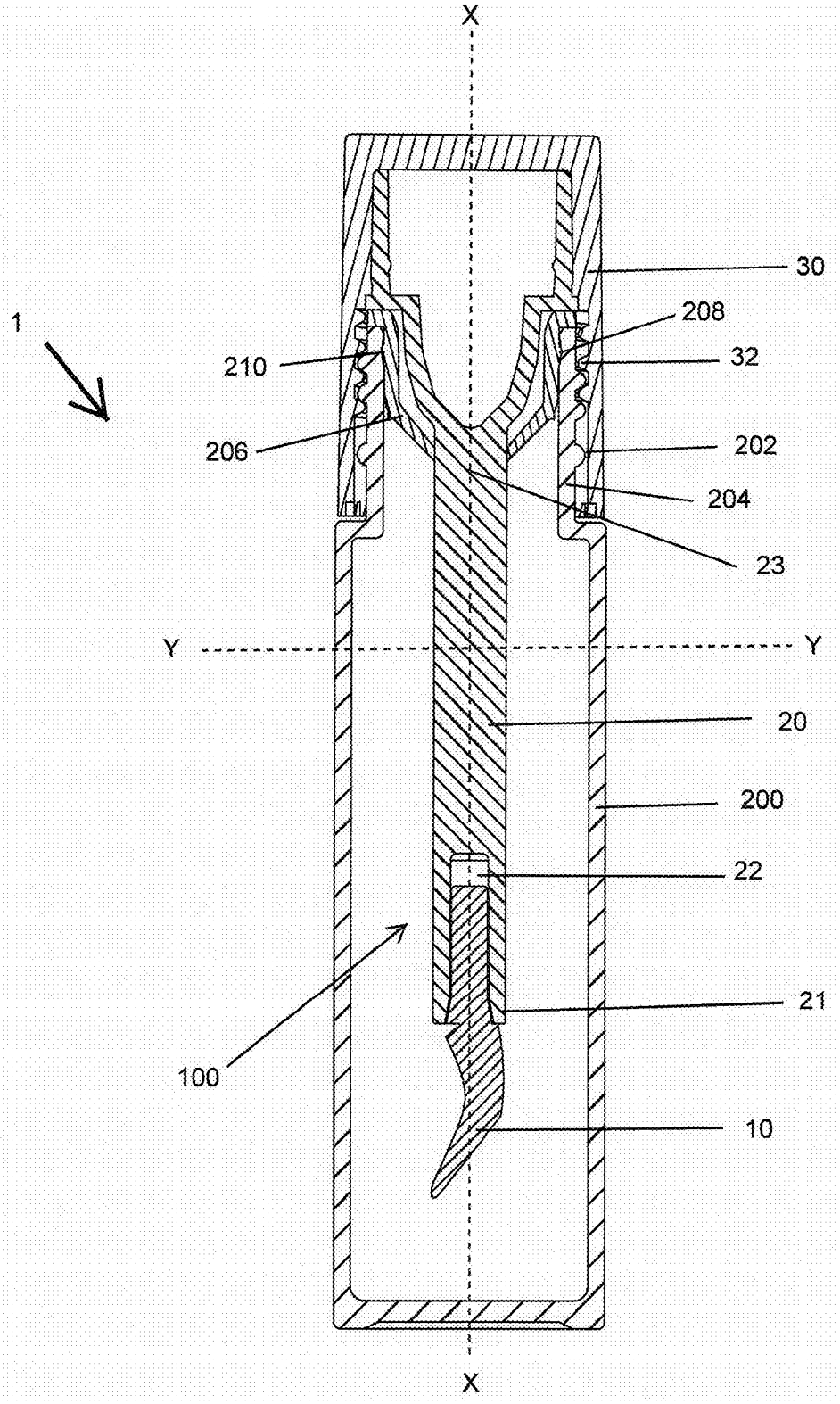
FIG. 2 illustrates a cross-sectional view of the cosmetic package of FIG. 1.

FIG. 1 illustrates a cosmetic package 1 in closed position according to an embodiment of the present disclosure. FIG. 2 illustrates a longitudinal sectional view of the cosmetic package 1 of FIG. 1. The cosmetic package 1 comprises a receptacle 200 and a cosmetic applicator 100. The receptacle 200 is configured to contain a product (not shown) including a cosmetic, care or pharmaceutical product. The cosmetic, care or pharmaceutical product includes viscous cosmetics, mascara, eyebrow powder, lip gloss, hair color, cheek blush, skin care, under eye cosmetics, pharmaceutical and like products.

In general, the use of the terms "distal" and "proximal" herein is supposed to mean that the distal side/end is the side/end facing towards the inside of the storage receptacle 200, whereas the proximal side or proximal end is the side or end facing towards the removal opening of the receptacle 200.

According to an embodiment and as shown in FIGS. 1 and 2, the cosmetic package 1 is of an elongated cylindrical configuration. However, in alternate embodiments, the cosmetic package 1 may be of an elongated square, polygonal configuration, oval, triangular, heart, or any other configuration known in the art.

According to an embodiment, the receptacle 200 may be made of a rigid material like glass, metal, hard plastic or any other material known in the art. In alternate embodiments, the receptacle 200 is made of a flexible material like flexible polymeric material or any other material known in the art.

As shown in FIG. 2, the cosmetic applicator 100 comprises an applicator head 10, a stem 20 and a cap 30. According to an embodiment, the cap 30 of the cosmetic applicator 100 has threads 32 on its inner surface which can be screwed onto threads 202, formed on an outer surface of a neck 204 of the receptacle 200. In alternate embodiments, the cap 30 snaps into place on the neck 204 of the receptacle 200 or any other type of mechanisms may be used to mate the cap 30 to the receptacle 200.

Inserted in the neck 204 of the receptacle 200 is a wiper 206 for wiping off excess cosmetic product from the cosmetic applicator 100. The wiper 206 also comprises an annular bead 208 on its outer surface for engaging into a corresponding annular groove 210 formed on an inside surface of the neck 204 of the receptacle 200.

The cosmetic applicator 100 comprises the applicator head 10 retained at a distal end 21 of the stem 20 for applying the cosmetic product; and the cap 30 at a proximal end 23 of the stem 20. The distal end 21 of the stem 20 includes an interior longitudinal cavity 22 for receiving and retaining the applicator head 10.

According to an embodiment of the present disclosure, the applicator head 10 and the stem 20 are fitted together by a snap fitment. In alternate embodiments, the applicator head 10 and the stem 20 are fit together by friction fit, by gluing, crimping, magnetic engagement and the like.

According to an embodiment of the present disclosure, the stem 20 can have a longitudinal axis X-X that is rectilinear as shown. In alternate embodiments, the stem is be curved.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow. When the stem 20 is not of circular cross-section, the cap 30 can possibly by fastened on the receptacle 200 by snap-fastening or by some other means, without turning relative to said receptacle 200. The wiper 206 can thus present a non-circular wiper orifice of section that is complementary to the cross-section of the stem 20.

According to an embodiment of the present disclosure, the applicator head 10 can be made, at least in part, from a material that is more flexible than a material from which the stem 20 is made. According to an embodiment of the present disclosure, at least a part and preferably all of the applicator head 10 can be made by molding, e.g. by injection-molding or other techniques known to those of skill in the art. The applicator head may be made from materials suitable for molding including by injection molding. Materials suitable for forming the applicator head will be appreciated by those of skill in the art as including thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP), and the like.

Figure 3:
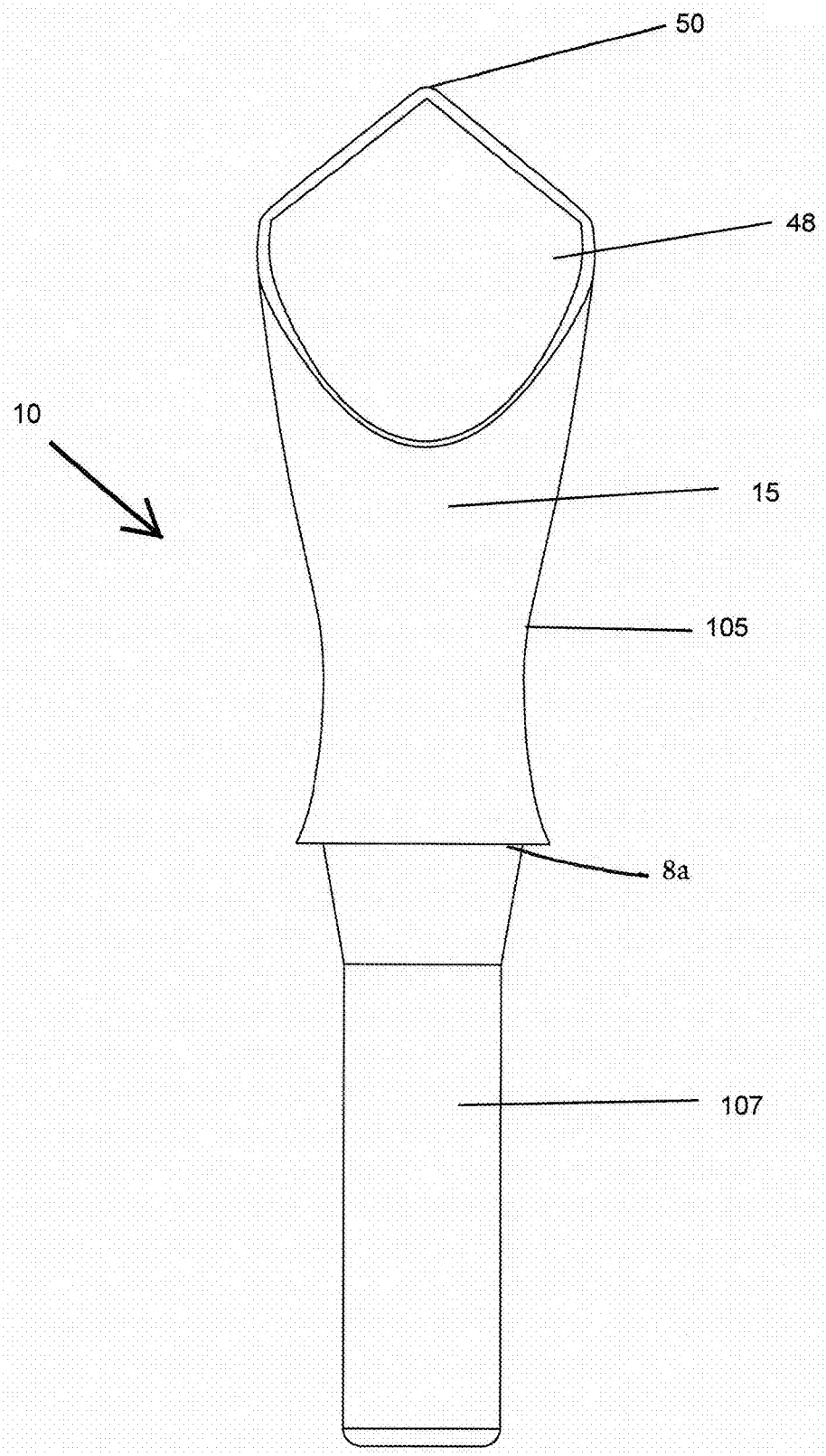
FIG. 3 illustrates a front view of an applicator head of the cosmetic package of FIG. 2.
Figure 4:
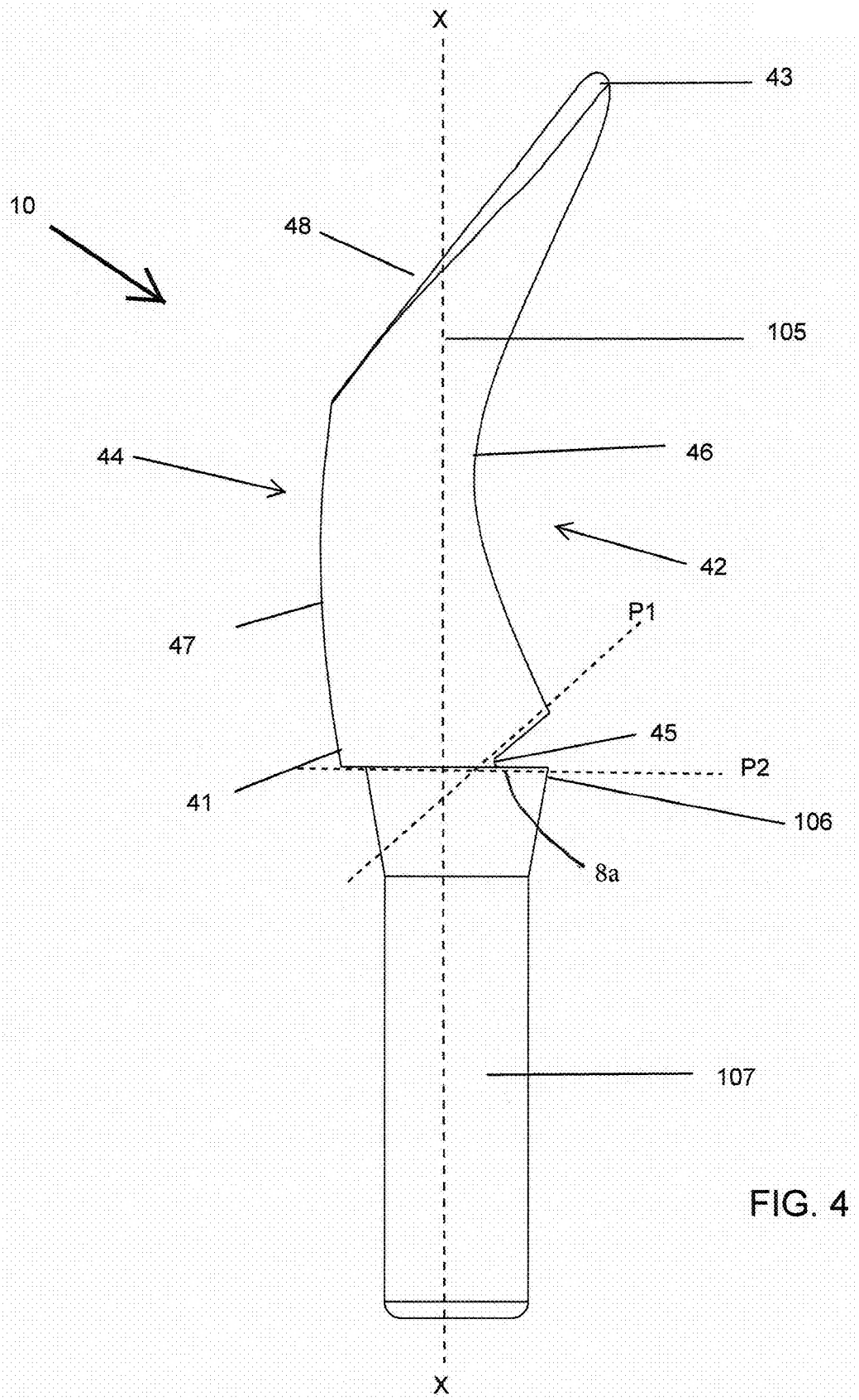
FIG. 4 illustrates a side view of the applicator head of FIG. 3.

FIGS. 3 & 4 show a front view and a side view of the applicator head 10 respectively. The applicator head 10 comprises an applying member or spatula 105 and a shank portion 107. The shank portion 107 is configured to be received within the cavity 22 of the stem 20 (refer FIG. 2). Root 8*a* is distal of shank 107.

According to an embodiment of the present disclosure, the applying member 105 is covered with application element which in this case is flocked fibers (not shown). Briefly, the fibers for flocking which may be of any commonly used material, such as nylon, polyester or any natural fiber are applied with an adhesive, such as an epoxy, to the surface to be flocked. The flocking finish to the surface of the applying member 105 may be achieved by an appropriately chosen known technique, such as electrostatic flocking. The applying member 105 before being flocked is smooth on its entire surface. That is, the applying member 105 before being flocked has no surface textures, such as a wrinkle finish or a matte finish, over the entire surface thereof. To put it another way, the applying member 105 before being flocked is smooth and slippery.

Preferably, the flocking process takes place in an electrostatic field, which results in the proper orientation of the fibers. The flock on the applying member 105 provides a layer which can hold a small amount of the cosmetic product adequate for one or two applications. In alternate embodiments, the applying member 105 includes injection molded fibers, projections or grooves which are capable of holding the cosmetic product.

As shown in FIGS. 3 & 4, the applying member 105 has an elongated support body 15 extending along a longitudinal axis X-X of the cosmetic applicator 100 (refer FIG. 2). The applying member 105 comprises at least two application faces namely a first application face 42 and a second application face 44.

According to a first embodiment of the present disclosure, the first application face 42 has a concave surface 46, wherein the concave surface 46 extends from a proximal end 41 of the applying member 105 to the distal end 43 of applying member 105. The concave surface 46 creates a volume reservoir. This volume reservoir serves as a reservoir for the cosmetic product. A significant quantity of the cosmetic product may be accommodated in said volume reservoir which is available to be applied to the user's skin or keratinous substrate.

As shown in FIG. 4, the second application face 44 has a convex surface 47 which is followed by an inclined flat surface 48. The convex surface 47 is located at a proximal portion of the applying member 105 and the inclined flat surface 48 is located at a distal portion of the applying member 105. More particularly, the convex surface 47 extends from the proximal end 41 up to a mid-length of the applying member 105. The inclined flat surface 48 extends from the mid-length of the applying member 105 to a distal end 43 of the applying member 105. A pointed tip 50 as seen in FIG. 3, is formed at the distal end 43 of the applying member 105.

The inclined flat surface 48 helps in precise deposition of the cosmetic product on applying the cosmetic product on the user's skin or keratinous substrate. For example, when the cosmetic product is applied on the user's lip edge, the applicator can be used to form a perfect cupid's bow, that is, a facial feature where the double curve of a human upper lip is said to resemble the bow of Cupid, the roman god of erotic love.

According to a further aspect of the present embodiment, a hinge 45 is formed between the proximal end 41 of the applying member 105 and root 8*a* at a distal end 106 of the shank portion 107. The hinge 45 is formed by intersection of two cutting planes, P1 and P2; wherein one of the two cutting planes is orthogonal to the longitudinal axis X-X of the cosmetic applicator 100 or in other words one of the planes is parallel to a transverse axis Y-Y of the cosmetic applicator 100 (refer FIG. 2). Further, the hinge 45 is present at one side of the applicator head 10 only. Particularly, there is a single hinge 45 in the applicator head 10 limited to a single zone in a circumference of the applicator head 10 between the shank portion 107 and the applying member 105. More particularly, as shown in FIG. 4; the hinge 45 is on a side of the applicator head 10, where the first application face 42 of the applying member 105 is located. In alternate embodiments, the hinge 45 is on a side of the applicator head 10 where the second application face 44 of the applying member 105 is located. The location and dimensions of hinge 45 are selected to modify the stiffness of the applicator head to forces applied when the applicator is used to apply a substance, for example, when the applicator is used to apply a cosmetic to a person's skin.

According to an embodiment of the present disclosure, the hinge 45 is to provide flexibility, that is, to modify the stiffness of the applying member 105 which abuts against the shank portion 107 of the applicator head 10 when flexed. The flexibility provided by the hinge 45 is to give user the feeling that the cosmetic applicator 100 is very soft and resilient.

Figure 5A:
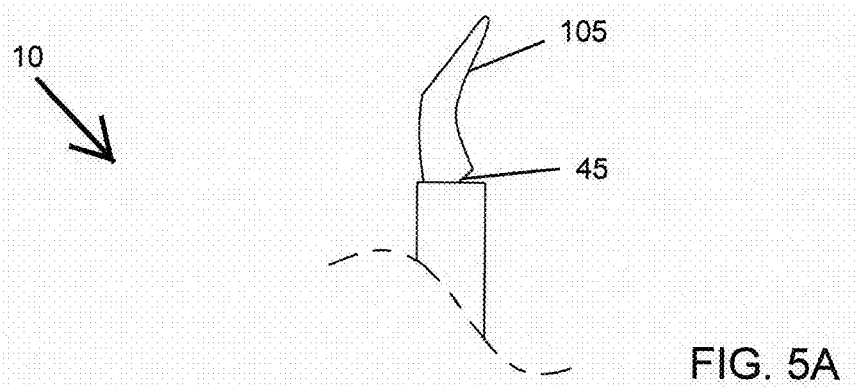
FIG. 5A illustrates an applying member of the applicator head of FIG. 4 in a non-flexed state.
Figure 5B:
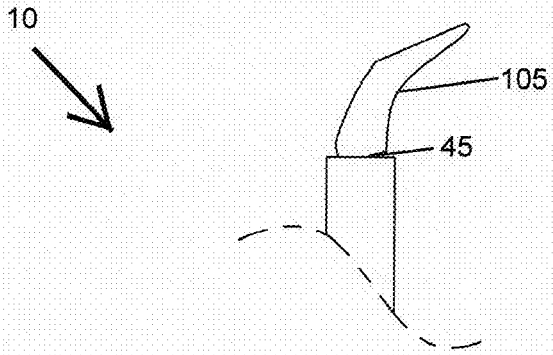
FIG. 5B illustrates a completely flexed state of the applying member of FIG. 5A.

According to an embodiment of the present disclosure, the applying member 105 flexes from a non-flexed state into a completely flexed state. FIG. 5A illustrates the applying member 105 in a non-flexed state. FIG. 5B illustrates the completely flexed state of the applying member 105. In the completely flexed state, the applying member 105 completely flexes in a single axis, the single axis being a pivot axis of the hinge 45, while resisting deflection in any other axes. This orientation provides the user with a selected feeling of softness and control of the cosmetic applicator 100.

Figure 6A:
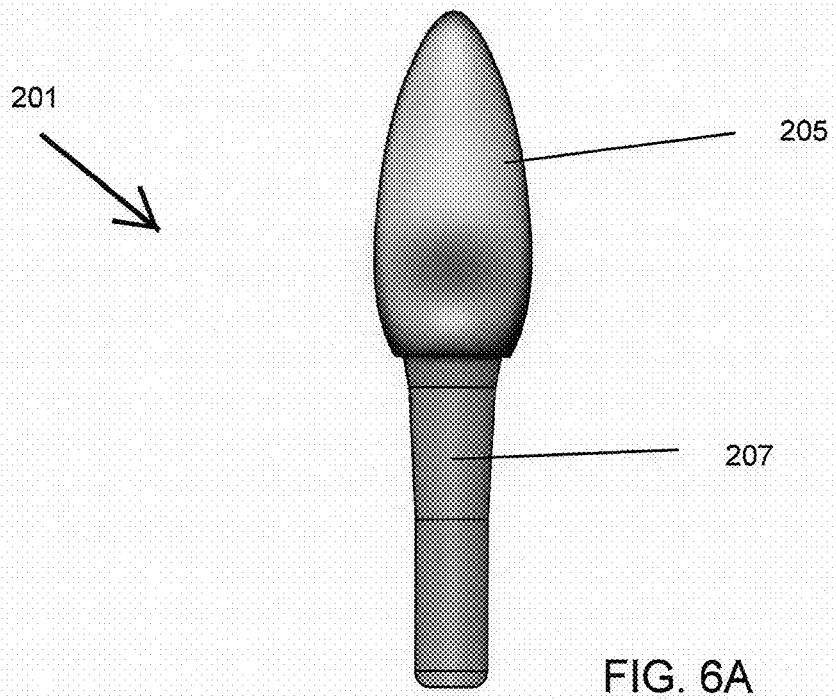
FIG. 6A illustrates a front view of an applicator head, according to a second embodiment of the present disclosure.
Figure 6B:
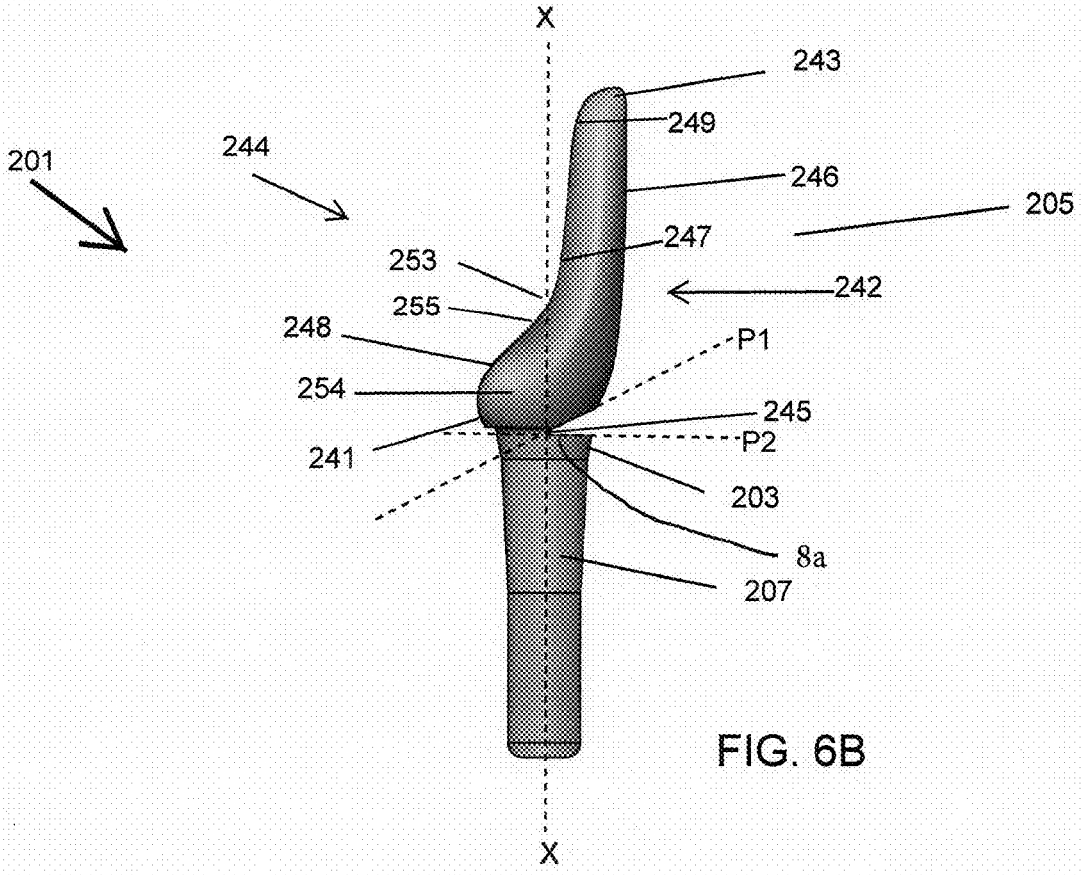
FIG. 6B illustrates a side view of the applicator head of FIG. 6A.

FIGS. 6A and 6B illustrate a front view and a side view of an applicator head 201 respectively according to a second embodiment of the present disclosure. The applicator head 201 comprises an applying member or spatula 205 and a shank portion 207. The applying member 205 comprises at least two application faces namely a first application face 242 and a second application face 244.

The first application face 242 is opposite to the second application face 244. The first application face 242 has a substantially flat surface 246 which extends from a proximal end 241 till a distal end 243 of the applying member 205.

The second application face 244 has a first convex surface 248 near the proximal end 241, a concave surface 247 at a middle portion 253 and a second convex surface 249 near the distal end 243 of the applying member 205. The second application face 244 when seen from the proximal end 241 to the distal end 243 of the applying member 205 comprises the first convex surface 248 which is followed by the concave surface 247 which in turn is followed by the second convex surface 249.

According to an aspect of the second embodiment, the first convex surface 248 of the second application face 244 forms of a bulbous portion 254 on the second application face 244.

According to a further aspect of the present disclosure, there is drastic decrease increase in thickness of applying member 205 afterwards the bulbous portion 254 of the applying member 205. In other words, the thickness of applying member decreases from the proximal end 241 to the middle portion 253 of the applying member 205. According to an aspect of the present embodiment, a thickness of the proximal end 241 is at least twice a thickness of the middle portion 253 or the distal end 243 of the applying member 205.

According to an embodiment of the present disclosure, a concave region 253 is created due to reduced thickness between the proximal end 241 and the distal end 243 of the applying member 205. More particularly, the concave region 253 is formed between the proximal end 241 and the middle region 253 of the applying member 205 on the second application face 244. The concave region 253 creates a volume reservoir. This volume reservoir serves as a reservoir for the cosmetic product. A significant quantity of the cosmetic product may be accommodated on said volume reservoir which is then ready to be applied to the user's skin or keratinous substrate.

Further as shown in FIG. 6B, a hinge 245 is formed between the proximal end 241 of the applying member 205 and a distal end 203 of the shank portion 207. The hinge 245 is formed by intersection of two cutting planes P1, P2, wherein one of the two cutting planes P1, P2 is orthogonal to the longitudinal axis X-X of a cosmetic applicator 200 or in other words one of the two cutting planes P1, P2 is parallel to a transverse axis of the cosmetic applicator 201. As seen in FIG. 6B, P2 is orthogonal to the longitudinal axis X-X of the applying member 205.

Further, the hinge 245 is present at one side of the applicator head 201 only. Particularly, there is only one hinge 245 in the applicator head 201 limited to a single zone in a circumference of the applicator head 201 between the shank portion 207 and the applying member 205. More particularly, as shown in FIG. 6B; the hinge 245 in the applicator head 201 is near to the first application face 242 of the applying member 205. This location of the hinge reduces the stiffness of the applying member 205 when force is applied to the second application face 244 toward the longitudinal axis. In alternate embodiments, the hinge 245 in the applicator head 201 is near to the second application face 244 of the applying member 205.

According to an embodiment of the present disclosure, the hinge 45, 245 is to provide flexibility to the applying member 105, 205 against the shank portion 107, 207 of the applicator head 10, 20. The flexibility provided by the hinge 45, 245 is to give user the feeling that the applying member 205 is very soft and resilient.

Figure 7:
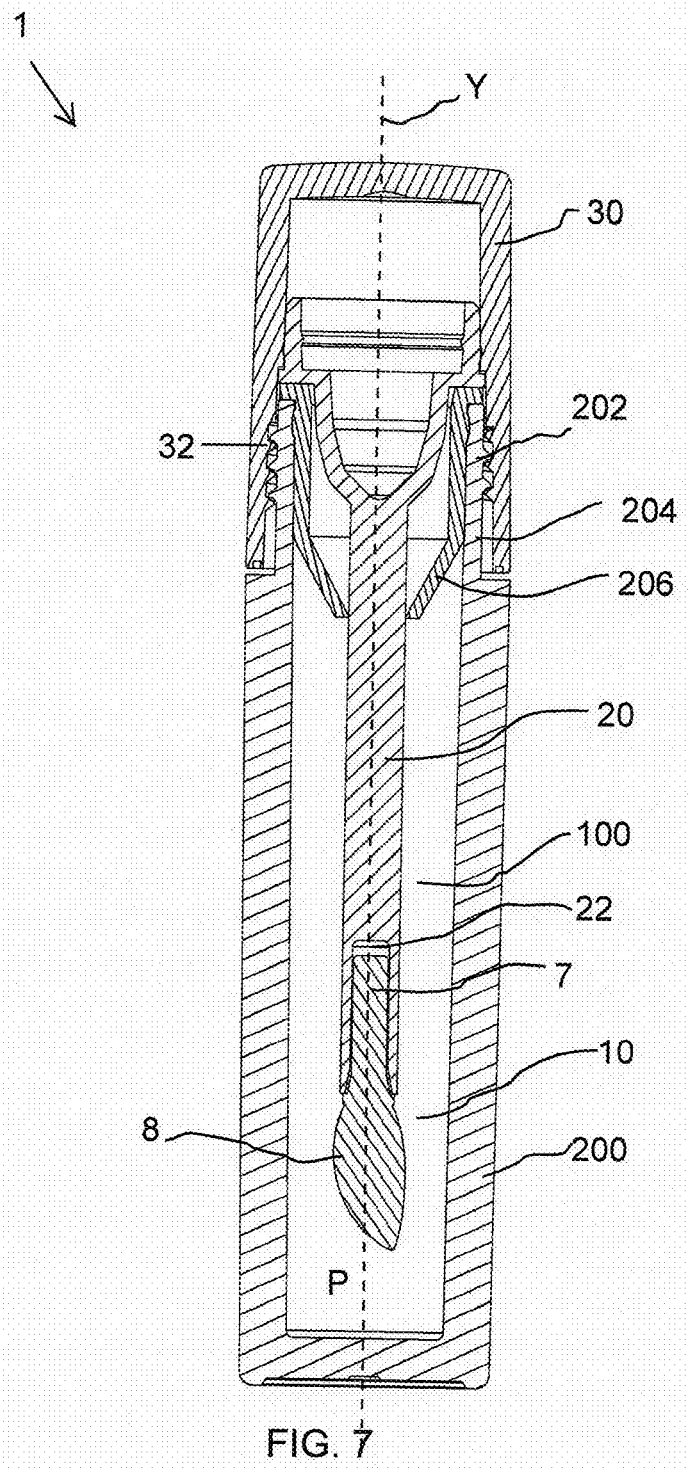
FIG. 7 shows a cross-sectional view of a cosmetic package equipped with a cosmetic applicator according to a third embodiment of present disclosure.

FIG. 7 illustrates a longitudinal sectional view of a cosmetic package 1. The cosmetic package 1 is similar to the one illustrated in FIG. 1. The package 1 comprises a receptacle 200 for holding a product (not shown) and a cosmetic applicator 100. The cosmetic applicator 100 comprises an applicator head 10, a stem 20, and a cap 30. The cap 30 of the cosmetic applicator 100 has threads 32 which can be screwed onto threads 202, formed on a neck 204 of the receptacle 200. The applicator head 10 is retained at a distal end of the stem 20 for applying the product; and the cap 30 at a proximal end of the stem 20.

Further, the distal end of the stem 20 includes an interior longitudinal cavity 22 for receiving and retaining the applicator head 10. Inserted in the neck 204 of the receptacle 200 is a wiper 206 for wiping off excess product from the applicator 100. Further, the applicator head 10 of cosmetic applicator 100 may be used to apply the product including a cosmetic or care product. The cosmetic or care product includes viscous cosmetics, mascara, eyebrow powder, lip gloss, hair color, skin care, under eye cosmetics, pharmaceutical and like products.

Figure 8:
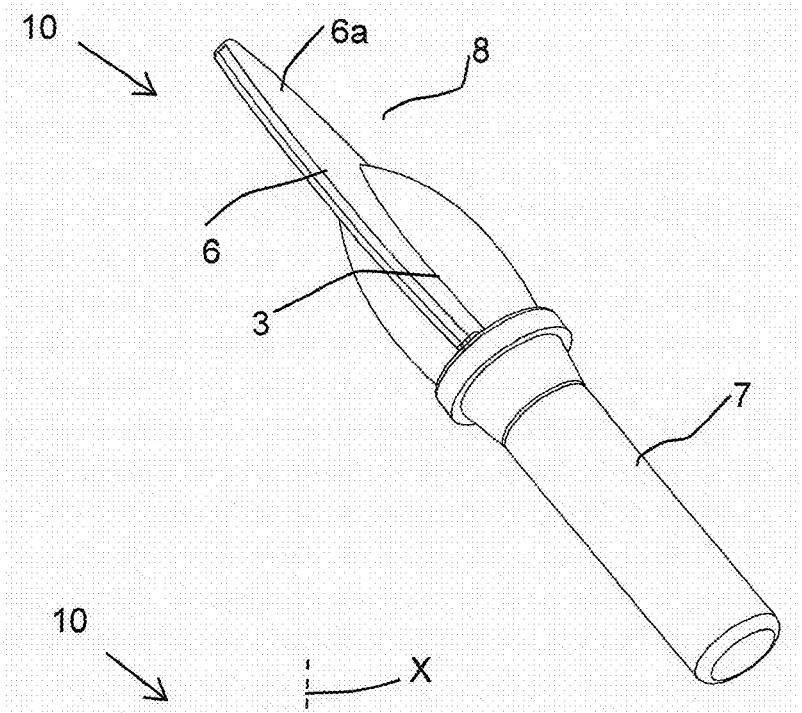
FIG. 8 shows a perspective view of an applicator head of the cosmetic applicator of FIG. 7.
Figure 9:
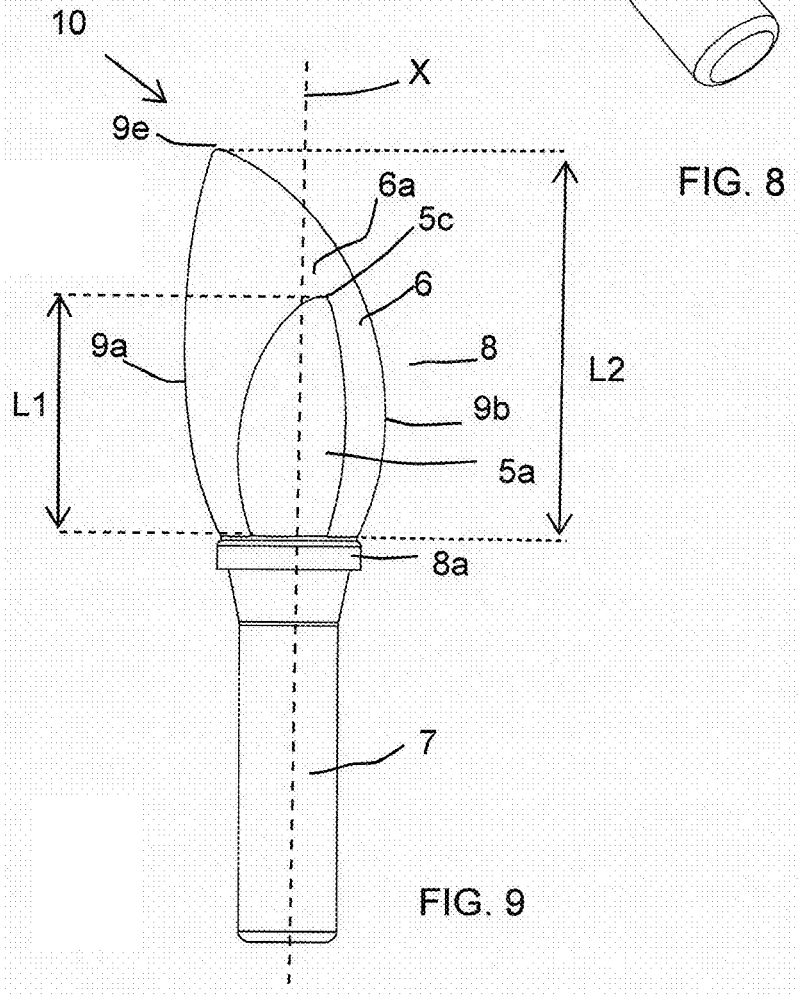
FIG. 9 shows a front view of the applicator head of FIG. 8.

As shown in FIGS. 7-9, the applicator head 10 comprises an applying member 8 at its distal portion and a shank member 7 at its proximal portion. The shank member 7 is configured to be received and retained within the cavity 22 of the stem 20. According to an exemplary embodiment shown in FIGS. 8-11, the applying member 8 is elongated along a central longitudinal axis X of the applicator head 10.

As seen in FIGS. 7 and 9, the applying member 8 has a longitudinal axis X which is in alignment with a longitudinal axis Y of the stem 22. The applying member 8 is elongated, that is to say its extent in the direction parallel to the longitudinal axis X is larger than its largest extension perpendicularly to the longitudinal axis X. Particularly preferably applies that the largest extension of the applying member 8 in the direction parallel to the longitudinal axis X by at least a factor of 1.5, more preferably is greater by at least a factor of 2 than the greatest extension of the applying member 8 in the direction perpendicular to the longitudinal axis X.

Referring to FIGS. 7-11, the applying member 8 comprises a spatula member 6 which is substantially a planar plate like structure. The spatula member 6 has two opposite main application faces opposite to each other, namely a first face 6*a* and a second face 6*b*. The applying member are8 further includes two convex bulges, namely a first convex bulge 5*a* and a second convex bulge 5*b* extending in opposite directions from respective of the first face 6*a* and the second face 6*b* of the spatula member 6.

Each of the first and second convex bulges 5*a*, 5*b* extends along a longitudinal direction from a root portion 8*a* of the applying member 8 to up to at least a half a length of the respective faces 6*a*, 6*b*.

Figure 12:
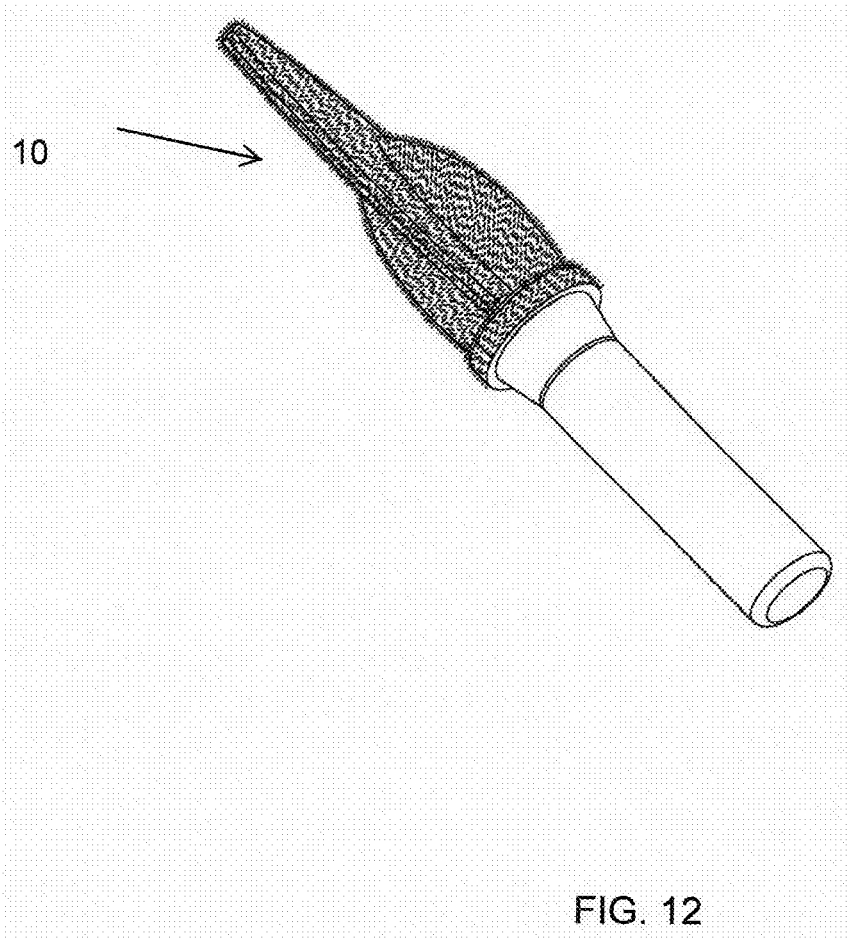
FIG. 12 shows a perspective view of the applicator head of the FIG. 8 with an applying member of the applicator head covered with flocking.

According to an embodiment of the present disclosure, an outer surface of the applying member 8 is covered with application element which in this case is flocked fibers, as shown in FIG. 12. Briefly, the fibers for flocking which may be of any commonly used material, such as nylon, polyester or any natural fiber are applied with an adhesive, such as an epoxy, to the surface to be flocked. The flocking finish to the outer surface of the applying member 8 may be achieved by an appropriately chosen known technique, such as electrostatic flocking. The applying member 8 may be flocked over substantially its entire visible surface. In a variant, at least one of the first and second convex bulges 5*a*, 5*b* of the applying member 8 may be flocked. In yet another variant, a portion 4 of the spatula member 6 free from the first and second convex bulges 5*a*, 5*b* that is used for applying the composition may be flocked.

According to an aspect of the present disclosure, the first and second convex bulges 5*a*, 5*b* define a rigid region on the applying member 8 that provides bending resistance during application and forms a suitable surface that allows to rub the product into the skin of a user. That is, the bulges 5*a*, 5*b* increase the cross section of the applying member 8 near the shank, thus modify the stiffness to the applying member 8 to increase it stiffness. The portion 4 of the spatula member 6 which is free from the first and second convex bulges 5*a*, 5*b* defines a flexible region which is flexible enough to flex and adjust according to contour of the application surface, thus allowing even and smooth application of the product during application.

Figure 10:
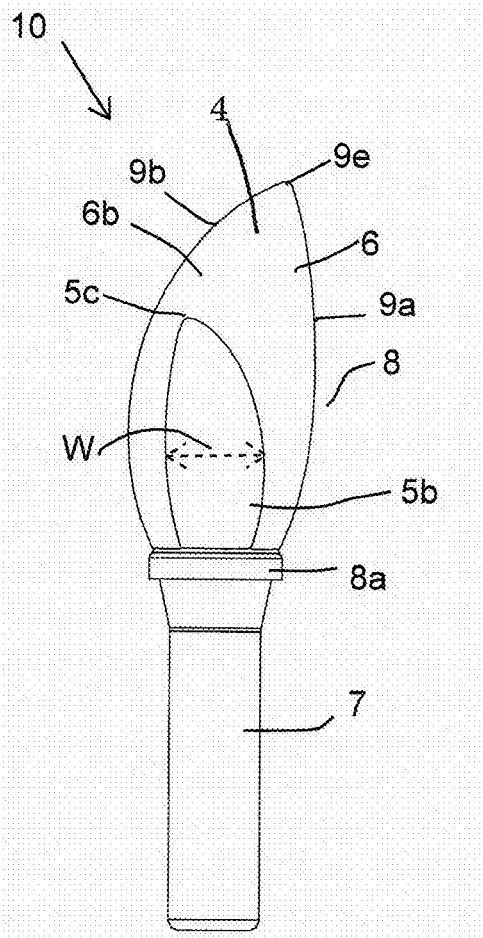
FIG. 10 shows a back view of the applicator head of FIG. 8.

Referring to FIGS. 9-10, the spatula member 6 comprises two lateral edges, namely a first lateral edge 9*a*, and a second lateral edge 9*b* which converge towards each other to form an off-centered pointed tip 9*c* at a distal end of applying member 8 with respect to the central longitudinal axis X of the applicator head 10. The first and second lateral edges 9*a*, 9*b* are outwardly convexly curved, wherein the curvature of the convex curve of lateral edge 9*a* is different from the curvature of the convex curve of the lateral edge 9*b*.

As seen in the FIGS. 9-10, each of the first and second convex bulges 5*a*, 5*b* has an off-centered distal end 5*c* with respect to the central longitudinal axis X of the applicator head 10. Each of the first convex bulge 5*a* and the second convex bulge 5*b* are spaced away from the first lateral edge 9*a* and the second lateral edge 9*b* of the spatula member 6.

According to a further aspect of the present disclosure, the off-centered pointed tip 9*e* of the spatula member 6 and the off-centered distal ends 5*c* of the convex bulges 5*a*, 5*b* lie on opposite sides/directions of the central longitudinal axis X, when viewed from front or back of the applying member 8, as shown in FIGS. 9 to 10.

According to an aspect of the present disclosure, the each of first and second convex bulges 5*a*, 5*b* are asymmetric with respect to the longitudinal axis X of the applying member 8. According to exemplary embodiment shown in FIGS. 8-11, the first and second convex bulges 5*a*, 5*b* are identical in shape and dimensions, and extend parallel to each other over their entire length. However, in alternate embodiments, the first and second convex bulges 5*a*, 5*b* may not be identical in shape and dimensions and may or may not extend in parallel directions.

Figure 11:
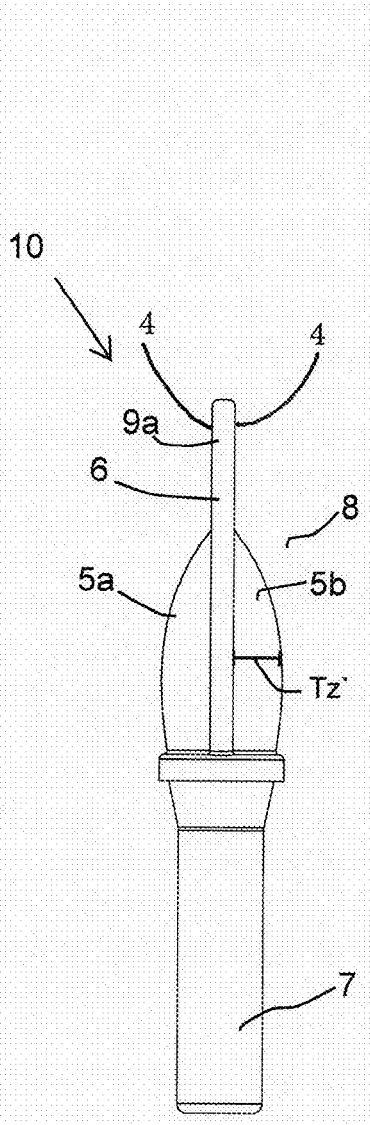
FIG. 11 shows a side view of the applicator head of FIG. 8.

Referring to FIG. 11, a maximum thickness, Tz, of the each of the first and the second convex bulges 5*a*, 5*b* is about 100 to 200% greater than a thickness in the spatula member 6. Preferably, each of the first and second convex bulges 5*a*, 5*b* has a thickness which varies along the longitudinal axis X. Preferably the thickness of the first and second convex bulges 5*a*, 5*b* increases from its proximal end to reach a maximum at around a mid-length and then decreases towards its distal end.

In accordance with the present embodiment, the first and second convex bulges 5*a*, 5*b* extend perpendicular from the first face 6*a* and the second face 6*b* respectively, and each having a maximum thickness on the average from about 1 mm to about 3 mm, in particular from about 1 mm to about 2 mm. Preferably, the spatula member 6 has an average thickness of at least about 0.5 mm, and particularly no more than about 2 mm, more in particular in the range from about 0.5 mm to about 1 mm.

A length, L1, of each of the first and second convex bulges 5*a*, 5*b* is about at least 60% of a total, L2, of the spatula member 6 but less than 90% of the length of the spatula member 6, refer FIG. 9. Preferably, the total length, L1, each of the first and second convex bulges 5*a*, 5*b* is longer than its width, W, for example, several times larger than the width of the convexity, i.e. more than 2, 3, 4, 5 or 6 times its width.

When seen from a proximal end towards the distal end of the applying member 8, the width of the convex bulges first increases, reaches a maximum and then decreases.

When seen from a proximal end towards the distal end of the applying member 8, the width of the spatula member 6 first increases, reaches a maximum and then decreases.

The first and second convex bulges 5*a*, 5*b* may have any geometric cross-section, and may be, e.g., a rounded or have a rectangular, triangular, square, or an irregular cross-section.

The spatula member 6 is flexible enough to flex during application along contours of the human facial skin or lips so as to provide an even coating of the cosmetic product. Further, the pointed tip 9*c* at the distal end allows the user to draw precision lines during application. The applying member 8 picks up generous amount of product near a base 3 (see FIG. 8) of the first and second convex bulges 5*a*, 5*b* to reduce the need to re-dip the applicator during application of the product.

According to an embodiment, the container 10 and the cap 30 may be made of a rigid material like glass, metal, hard plastic or any other material known in the art. However, in alternate embodiments, the container 10 and the cap 30 may be made of a flexible material like flexible polymeric material or any other material known in the art.

According to an embodiment of the present disclosure, at least a part and preferably all of the applicator head 10 can be made by molding, e.g. by injection-molding. Applicator head may be made from suitable materials known to those of skill in the art including thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); and the like.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow.

When the stem 20 is not of circular cross-section, the cap 30 can possibly by fastened on the receptacle 200 by snap-fastening or by some other means, without turning relative to said receptacle 200. The wiper 206 can thus present a non-circular wiper orifice 215 of section that is complementary to the cross-section of the stem 20.

According to an embodiment of the present disclosure, the applicator head 10 can be made, at least in part, from a material that is more flexible than a material from which the stem 20 is made.

According to an embodiment, the receptacle 200 and the cap 30 may be made of a rigid material like glass, metal, hard plastic or any other material known in the art. However, in alternate embodiments, the receptacle 200 and the cap 30 may be made of a flexible material like flexible polymeric material or any other material known in the art.

According to an embodiment of the present disclosure, the applicator head 10 and the stem 20 are fitted together by a snap fitment. In alternate embodiments, the applicator head 10 and the stem 20 are fit together by friction fit, by gluing, crimping, magnetic engagement and the like.

According to an embodiment of the present disclosure, the stem 20 can have a longitudinal axis X-X that is rectilinear as shown. However, in alternate embodiments, the stem is curved.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A system for applying a substance to a keratinous surface comprising:

a container for holding the substance;

an applicator comprising a stem and an applicator head arranged along a longitudinal axis, the applicator head comprising:

a shank joining a proximal portion of the applicator head with a distal portion of the stem;

a root connected with a distal end of the shank extending in the distal direction from the shank;

a stiffness modifying portion having a selected cross section perpendicular to the longitudinal axis and comprising a bulge connected with the root; and a spatula connected with the root and the stiffness modifying portion, the spatula extending along the longitudinal axis and adapted to hold and apply the substance to the keratinous surface, wherein the selected cross section provides a selected resistance to deflection of the spatula away from the longitudinal axis, wherein the spatula is substantially planar having a planar main application surface and comprising first and second curvilinear edges extending from the root, wherein the first and second curvilinear edges meet at a distal end of the spatula to form a spatula tip, wherein the first and second curvilinear edges are outwardly convexly curved and extend continuously from the root to the tip, wherein the bulge extends distally partially across the planar surface, wherein the bulge comprises a bulge proximal end joined with the root and a bulge tip at a bulge distal end, and wherein the bulge further comprises a bulge perimeter where the bulge meets the planar surface, wherein the bulge perimeter is offset along the first and second planar surfaces inward from the first and second peripheral edges, wherein the tip is offset from the longitudinal axis in a first direction, wherein the bulge tip is offset from the longitudinal axis in a second, opposite direction.

2. The system of claim 1, wherein the applicator head further comprises a flocked surface, the flocked surface covering at least a portion of the head.

3. The system of claim 1, wherein the bulge extends from the root in a distal direction parallel with the longitudinal axis.

4. The system of claim 3, wherein the spatula comprises two opposite planar main application surfaces opposite to each other, wherein the bulge comprises two bulges, and wherein each bulge is disposed along a respective one of the two main application surfaces of the spatula.

5. The system of claim 4, wherein, each bulge extends from the root to up to at least a half a length of the respective main application face along the longitudinal axis.

6. The system of claim 4, wherein each bulge extends from the root to up to between about 60% and about 90% of the length of the respective main application face along the longitudinal axis.

7. The system of claim 4, wherein each bulge has a width perpendicular to the longitudinal axis that varies along the longitudinal axis, and wherein, from the root along the longitudinal axis, the width first increases, then reaches a maximum and then decreases.

8. An applicator for applying a cosmetic, the applicator comprising:

a stem having a longitudinal axis; and an applicator head connected with a distal end of the stem and extending in a distal direction, wherein the applicator head comprises:

a root at a proximal end;

a spatula connected with the root and extending in the distal direction, wherein the spatula is substantially planar and has first and second planar surfaces; and two bulges connected with the root, wherein each bulge extends distally partially across respective ones of the first and second surfaces of the spatula, wherein each bulge comprises a bulge proximal end joined with the root and a bulge tip at a bulge distal end, and wherein each bulge comprises a bulge perimeter where the bulge meets the respective planar surface, wherein the spatula comprises, a first peripheral edge comprising a first proximal end joined with the root and extending in the distal direction to a distal end of the spatula; and a second peripheral edge comprising a second proximal end joined with the root and extending in the distal direction to the distal end of the spatula, wherein the first and second peripheral edges form a spatula tip at the distal end of the spatula, and wherein the first and second peripheral edges are outwardly convexly curved and extend continuously from the root to the tip, wherein the bulge perimeters are offset along the first and second planar surfaces inward from the first and second peripheral edges, wherein the tip is offset from the longitudinal axis in a first direction, wherein the bulge tip of each bulge is offset from the longitudinal axis in a second opposite direction.

9. The applicator of claim 8, wherein a curvature of the first peripheral edge is different from a curvature of the second peripheral edge.

* * * * *